United States Patent [19]

Swenson

[11] 4,418,768

[45] * Dec. 6, 1983

[54] MANUAL TORQUE MAGNIFYING IMPACT TOOL

[76] Inventor: Oscar J. Swenson, 630 S. Poplar Way, Denver, Colo. 80224

[ * ] Notice: The portion of the term of this patent subsequent to May 10, 2000 has been disclaimed.

[21] Appl. No.: 414,021

[22] Filed: Sep. 2, 1982

[51] Int. Cl.[3] ..... B25P 15/02

[52] U.S. Cl. ..... 173/93.5; 81/177 G

[58] Field of Search ..... 173/93, 93.5, 93.6, 173/93.7; 81/60, 177 G, 180 R, 465, 466, 463

[56] References Cited

U.S. PATENT DOCUMENTS

| | | | |
|---|---|---|---|
| 2,603,998 | 7/1952 | Schwartz | 81/177 G X |
| 2,661,647 | 12/1953 | Swenson | 173/93.5 |
| 2,844,982 | 7/1958 | Swenson | 173/93.5 X |
| 2,954,714 | 10/1960 | Swenson | 173/93.5 |
| 3,108,506 | 10/1963 | Swenson | 173/93.5 |
| 3,180,185 | 4/1965 | Schmidt et al. | 173/93 |
| 3,184,998 | 5/1965 | Young | 173/93.5 |
| 4,184,552 | 1/1980 | Anderson | 173/93.5 |
| 4,293,044 | 10/1981 | Anderson | 173/93.5 |

FOREIGN PATENT DOCUMENTS

| | | | |
|---|---|---|---|
| 1191282 | 10/1959 | France | 81/60 |

*Primary Examiner*—Frederick R. Schmidt
*Assistant Examiner*—Robert P. Olszewski
*Attorney, Agent, or Firm*—Richard L. Johnston

[57] ABSTRACT

An improved manually operated torque magnifying impact tool is provided having an improved drive, an improvement for reducing friction loss in operation of the tool, an improvement for stopping rotation of the inertia member, improved ratcheting, improved clearance adjustment between the frame members and the inertia members, an improvement for precluding gauling between bearing surfaces during the operation of the tool, an improved disengagement of ratcheting members and engagement of such members to the fullest extent, and improved disengagement of the ratcheting members and stopping the rotation of the inertia member.

13 Claims, 18 Drawing Figures

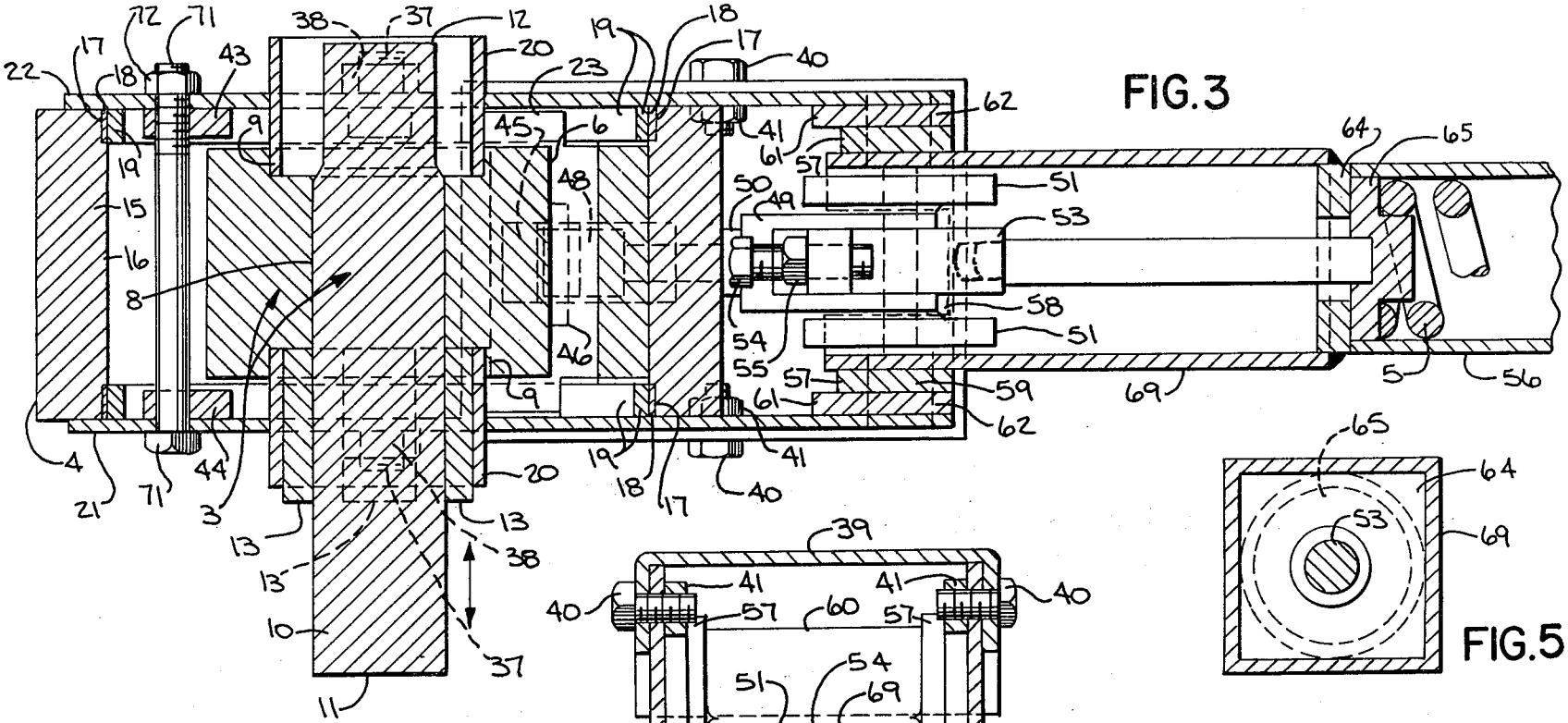
FIG.3
FIG.5
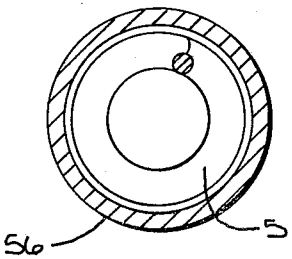
FIG.6
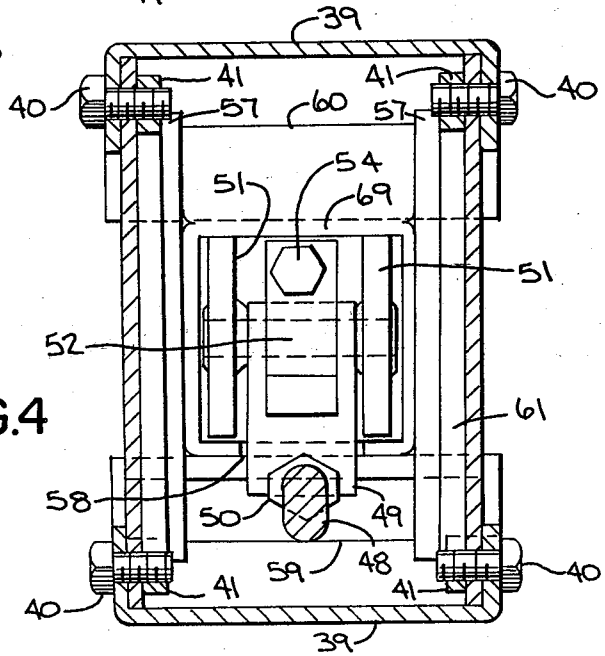
FIG.4

MANUAL TORQUE MAGNIFYING IMPACT TOOL

BACKGROUND

This invention relates to manually actuated impact tools for applying a torsional force, greater than that applied manually to the tool, to threaded type fastenings, such as tools of the type shown in U.S. Pat. Nos. 2,661,647, 2,844,982, 2,954,714, 3,108,506, and 3,156,309, but relates particularly to improvements in the manual impact tools shown in my co-pending U.S. patent application Ser. No. 324,024, filed Dec. 3, 1981, issued as U.S. Pat. No. 4,382,476. Each of these patents and the said co-pending patent application, in common with this application, shows a manually operable impact tool utilizing a manually operable handle, a main power spring, and an annular inertia member carrying pawls which engage a ratchet-toothed member with an output shaft to produce, from energy derived from movement of the handle by torque applied thereto by the operator and stored in and later released by the spring, successive impacts which are delivered as torque through the output shaft to a threaded fastener such as a bolt or nut to tighten or loosen it, when the pawls, disengaged from their respectively engaged ratchet teeth on angular movement of the handle relative to the inertia member, engage their respective successive ratchet teeth and release thereto as impact energy the energy stored in the spring and conveyed to the pawls by the inertia member, to result in a magnitude of torque delivered to the output shaft, and through it to the engaged threaded fastener, substantially greater than that of the torque applied to the handle by the operator.

Although the said co-pending patent application provides important improvements over the constructions of the impact tools shown in the said patents, this application provides improvements directly related to those of the said co-pending application, as well as additional improvements not so related.

BRIEF SUMMARY OF THE INVENTION

This invention provides improvements to manually operated torque magnifying impact tools, and particularly to the tools shown in my co-pending U.S. patent application Ser. No. 327,024, filed Dec. 3, 1981, issued as U.S. Pat. No. 4,382,476, the disclosure of which is made a part hereof and incorporated herein by reference, consisting of a removable, reversible drive bar with drive portions of two sizes to enable engagement with two drive sizes of sockets used for engaging threaded fasteners without the need for an adapter therefor, as well as reducing the weight of the tool itself with said bar removed to make for easier handling by the tool operator; a roller to replace the cross slide in the linkage between the inertia member and the power spring of fomer constructions to reduce friction loss in operation of the tool;

A compression and recoil member to improve use of the power spring as a recoil spring to stop rotation of the inertia member, and to improve ratcheting action of the tool; a bolt passing transverse the tool within the inertia member to join the frame members and enable adjustment of the clearance between the frame members and the inertia member; an unattached intermediate bearing member between the bearing surface of the inertia member and the bearing surface for the inertia member on the frame members of the tool, the composition of the material of said intermediate bearing member being different from the composition of the material of one of the said bearing surfaces to preclude gauling between said surfaces during operation of the tool; means to provide for engagement of the pawls with the ratchet teeth to less than the full depth of the ratchet teeth during the spring compression portion of the operating cycle of the tool to reduce the energy required for disengagement of the pawls, and for engagement of the pawls to the full depth of the ratched teeth on impact therewith; and improved means for disengagement of the pawls from the ratchet teeth and for stopping the rotation of the inertia member.

DETAILED DESCRIPTION OF THE INVENTION

The best mode contemplated for the practice of the invention is illustrated in the drawings and the accompanying description wherein:

FIG. 3 is a cross sectional view taken along the line 3—3 of FIG. 2;

FIG. 4 is a cross sectional view taken along the line 4—4 of FIG. 2;

FIG. 5 is a cross sectional view taken along the line 5—5 of FIG. 2;

FIG. 6 is a cross sectional view taken along the line 6—6 of FIG. 2;

Figure 1:
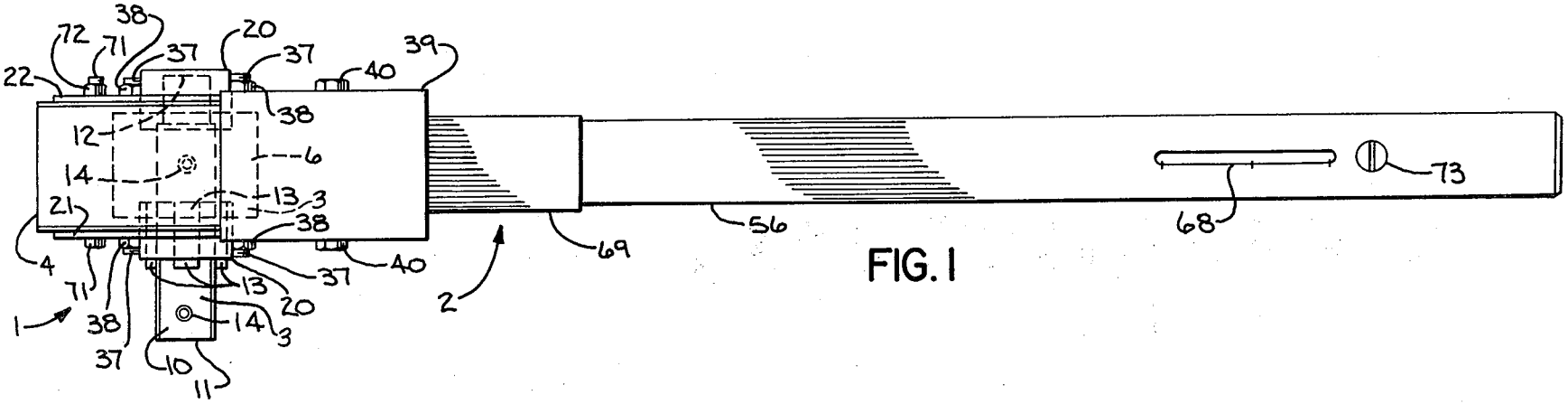
FIG. 1 is a plan view illustrating a manually operated torque magnifying impact tool constituting the best mode contemplated for the practice of the invention in which the larger end of drive bar 10 is shown in the optional position for counterclockwise torque output.

Referring to FIGS. 1 through 18, and substantially in common with the torque magnifying tools of the said co-pending patent application, the tool or tool assemblies of this invention comprise essentially: (a) a tool head 3, consisting of a cylindrical ratchet portion 6 having peripheral, parallel and equally spaced ratchet teeth 7, a circular bearing surface 9 at each end of said ratchet portion on a common axis therewith, and a square axial opening 8 between said bearing surfaces; (b) a square drive bar 10 of uniform square dimension only sufficiently less than that of opening 8 to enable insertion of either end of said bar freely into said opening from either side of the tool, stops 13 attached to said bar intermediate the ends thereof to limit the distance of said insertion and to provide, in combination with the length of the bar, for extension thereof a desirable distance outside of the tool on the side of said insertion, and a square portion 12 of square dimension less than that of said bar, integral therewith, and extending beyond the end of said bar opposite the end 11 thereof; (c) an annular inertia member 4 surrounding the ratchet portion 6 on a common axis therewith; frame members 21 and 22 transverse the said axis at each end of the inertia member 4, respectively, and joined by bolt 71, nut 72, cross members 39, cap screws 40 and nuts 41; and flange 57 carrying pin 59 and pin 60 operating pivotally and reciprocatingly, respectively, in bearing 62 and slot 63, respectively, on support member 61 attached to frame members 21 and 22; (d) a handle assembly 2 consisting of an elongated roller cage 69 attached at one end to flange 57 and at the opposite end to a spring stop 64 with a tube member 56 attached thereto and extending perpendicularly to said inertia member axis; (e) bearing members 19 and 20 attached to each of frame members 21 and 22 mating with intermediate bearing member 18 and surface 17 on inertia member 4 and with bearing surface 9 on ratchet portion 6, respectively, guiding tool head 3, inertia member 4, frame members 21 and 22, and handle 2 for angular rotation relative to each other about said axis; (f) the combination of a pitman assembly 47, consisting of pin 46, bearing member 48, nut 50, and yoke 49 and operating in slot 45 on inertia member 4 and pitman well 58 in handle 2, and a compression and recoil member 53 carrying pin 52 with rollers 51 operating thereon within roller cage 69, said combination operatingly connecting inertia member 4 to a power compression spring 5, between thrust members 65 and 66 within tube member 56, to enable storing energy in and releasing energy from spring 5 on angular movement of handle 2 relative to inertia member 4, and on angular movement of inertia member 4 relative to handle 2, respectively; (g) a spring adjusting screw 67 operating in nut 70 attached to tube member 56 by screws 72 and spring adjusting gauge 68 for setting desired initial compression of spring 5 against spring stop 64; (h) one or more pawls 23 with ends 29 movably seated in seat 26 formed by inner surface 16 of inertia member tube 15 and abutment 25 attached thereto, end 30 of said pawl operable freely against retaining member 28 attached to said surface and biased by springs 27 for engagement with and disengagement from ratchet teeth 7, notch 24 on said pawl providing clearance with bearing member 19 during said disengagement; (i) stop members 42 on frame members 21 and 22, and stop members 44 and 43 on frame members 21 and 22, respectively, cooperating with pawl ends 30 to limit angular rotation of inertia member 4 relative to handle 2 in one direction about said axis; and (j) cams 36, one for each pawl 23, consisting of cap screws 37 attached to frame members 21 and 22 by nuts 38, said cams operable against pawls 23 on angular movement of handle 2 about said axis relative to inertia member 4 and tool head 3 in a predetermined direction to enable disengagement of the pawls 23 from the ratched teeth 7, subsequent rotation of the inertia member 4 about said axis in said predetermined direction relative to ratchet 6, and reengagement of pawls 23 with the respective successive ratchet teeth 7, to impart thereto as impact, energy released from spring 5.

In accordance with the description in the preceding paragraph and by reference to the said Figures, and assuming that the tool head 3 is held rotationally immobile by the drive bar 10 being suitably connected, as with a commonly used socket, to a threaded fastener being serviced by the tool, it will be apparent that continuous angular movement of the handle 2 in a clockwise direction about the said axis relative to ratchet 6 and inertia member 4 will result in successive cycles of disengagement of the pawls 23 from the ratchet teeth 7 by the cams 36 and reengagement of the pawls 23 with the ratchet teeth 7 with impact force to produce torque on the ratchet 6 and drive bar 10, and therefrom to the fastener being serviced by the tool, the magnitude of said torque so delivered being greater than that of the torque applied to the handle of the tool by the operator.

IMPROVED DRIVE BAR CONSTRUCTION

In the tool of the said co-pending patent application the drive bar passes through the ratchet member and extends to a point outside of the tool on each side, to engage a socket on one side of the tool to drive a threaded fastener in a clockwise direction and on the other side of the tool to engage and drive the socket in counterclockwise direction. The drive bar is held in place longitudinally with respect to the ratchet member by tabs welded to the bar at each side of the ratchet member. The drive bar can be removed, such as for replacement as a result of breakage, only by grinding away the welds attaching one of the tabs to the bar. An important object of this invention is to provide a drive bar construction that enables the bar to be readily removed and inserted into the tool on either side of the tool to change the direction of output drive direction of the tool permitting the drive bar to be carried separately from the tool, as with the kit of sockets required to serve the tool, for reduction in weight of the tool itself for easier handling by the operator, particularly with the larger sizes of the tool. The shorter drive bar required by the improved construction further reduces the combined weight of the tool and the drive bar.

An important advantage of the improved construction of the drive bar is that provision can be made to enable engagement of the bar with commercially available sockets to engage threaded fasteners with socket drive openings of two different sizes, such as $\frac{3}{4}''$ and $\frac{1}{2}''$, $1''$ and $\frac{3}{4}''$, $1\frac{1}{4}''$ and $1''$, $1\frac{1}{2}''$ and $1\frac{1}{4}''$, and so forth, without the need for use of an adapter fitting between the tool and the socket, thus substantially increasing the versatility for application of the tool.

Figure 2:
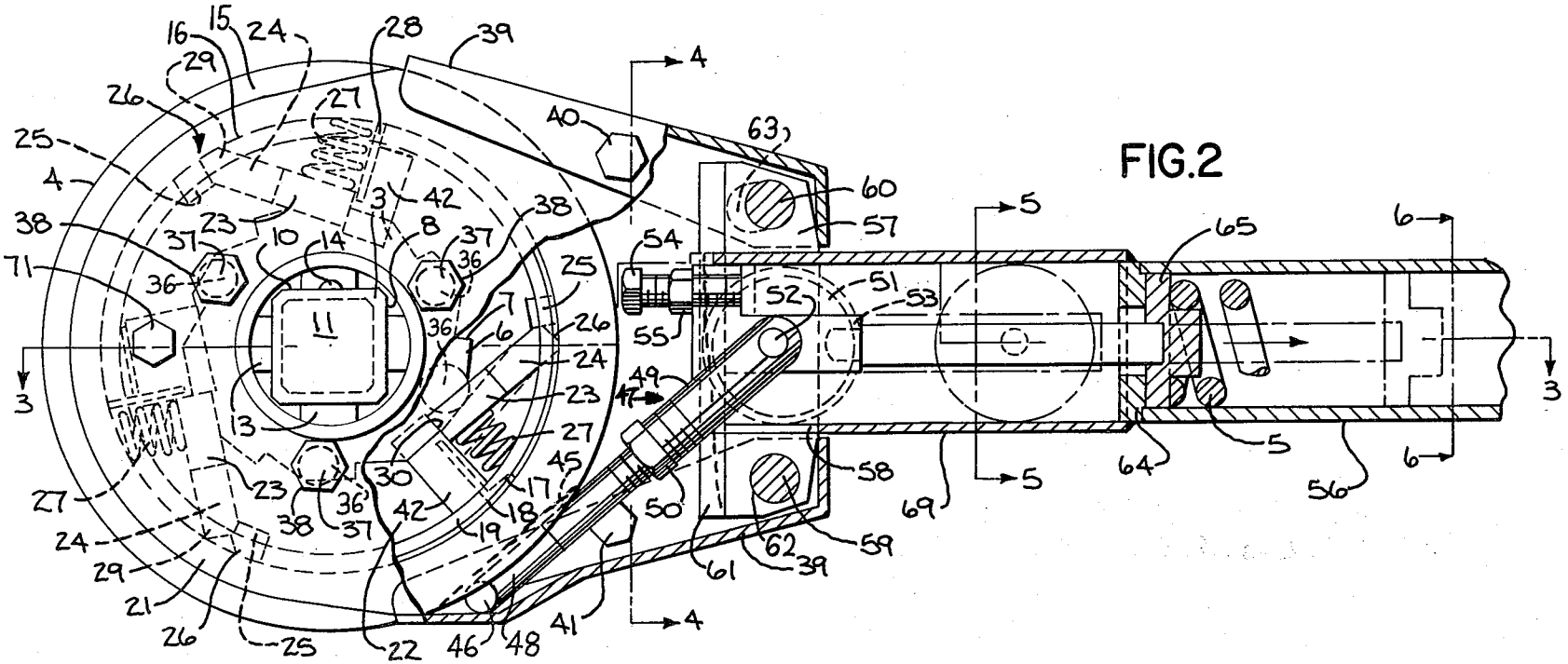
FIG. 2 is a cross sectional view taken vertically through bar 10 of FIG. 1.
Figure 7:
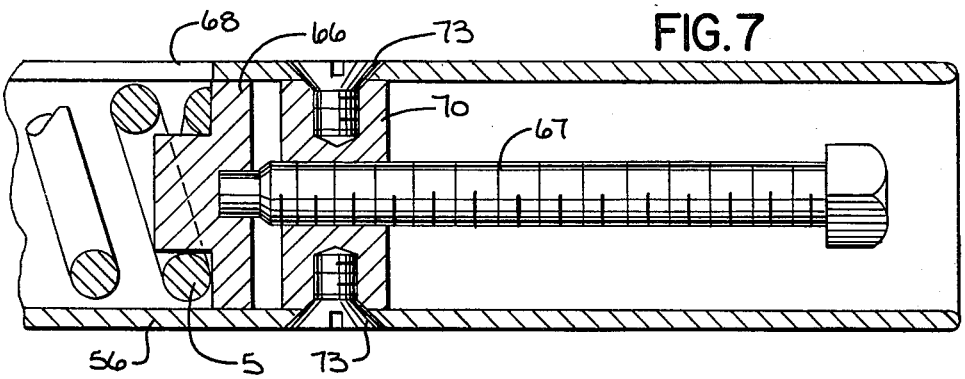
FIG. 7 is a cross sectional view taken vertically through handle 2 of FIG. 1.
Figure 8:
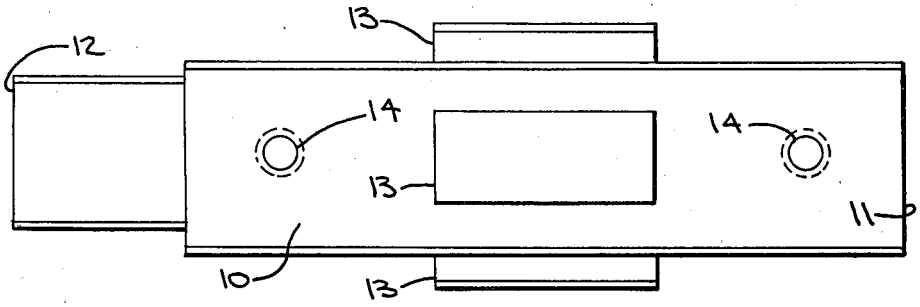
FIG. 8 is a transverse view of bar 10 of FIGS. 1, 2 and 3.
Figure 9:
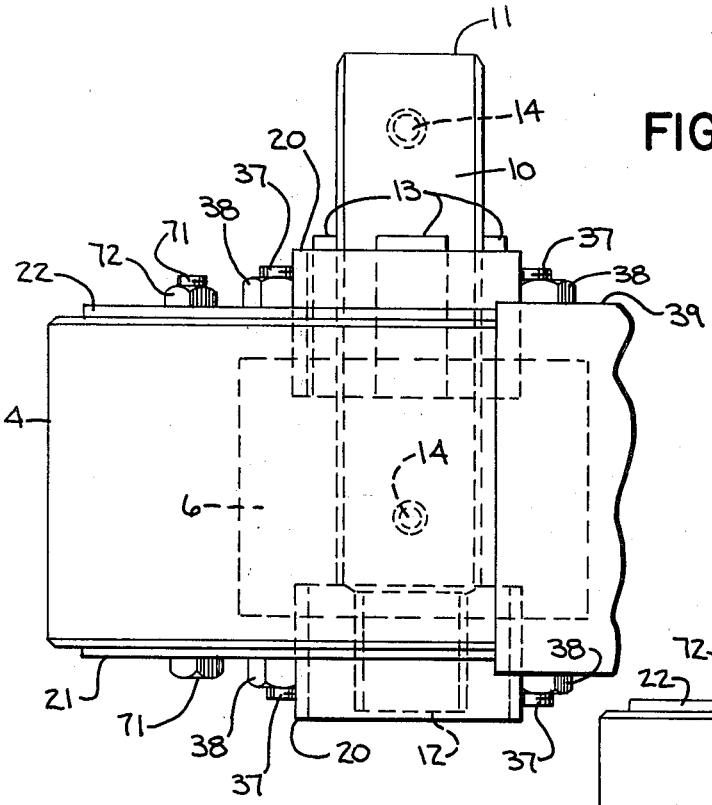
FIG. 9 is a plan view of the tool in which the larger end of drive bar 10 is shown in the optional position for clockwise torque output.
Figure 10:
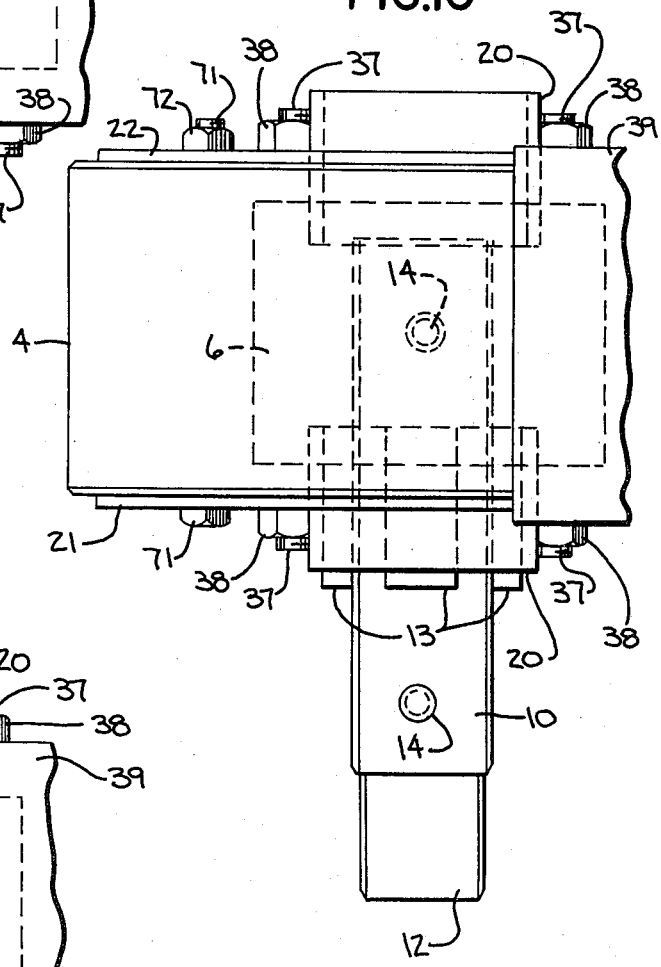
FIG. 10 is a plan view of the tool in which the smaller end of drive bar 10 is shown in the optional position for counterclockwise torque output.
Figure 11:
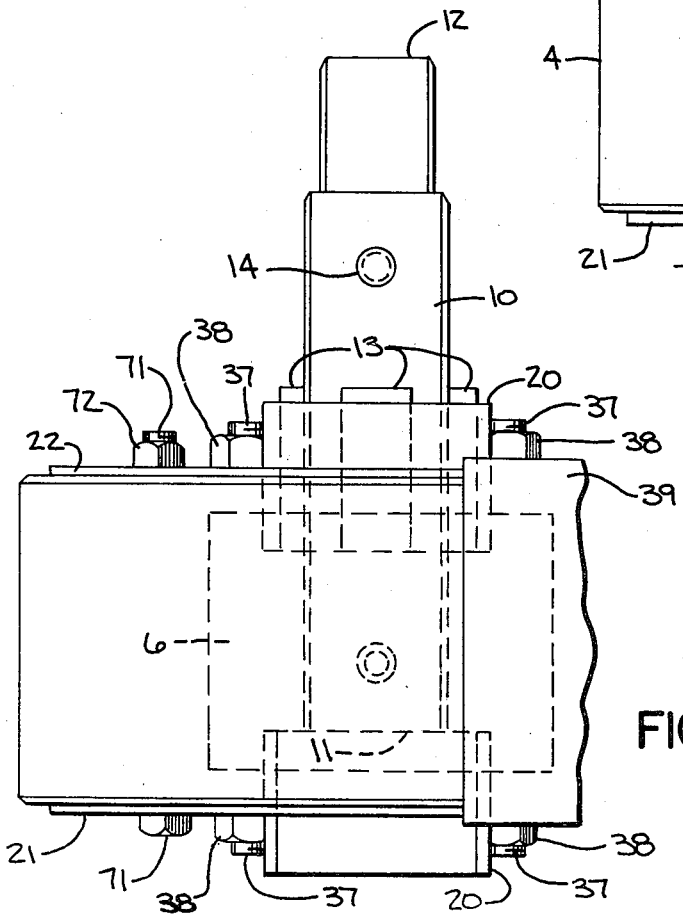
FIG. 11 is a plan view of the tool in which the smaller end of drive bar 10 is shown in the optional position for clockwise torque output.
Figure 13:
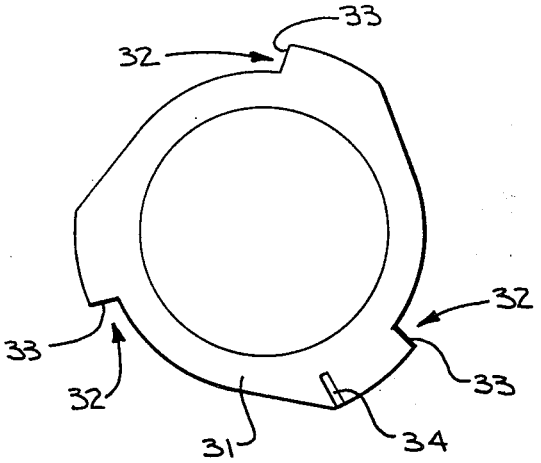
FIG. 13 is a detailed view of a portion of the device shown in FIG. 12.

FIG. 1 shows the improved drive bar 10 installed in the tool for engagement of the larger end 11 with a socket to deliver torque thereto in counterclockwise direction such as in loosening a threaded fastner with right hand thread. FIG. 9 shows drive bar 10 installed in the tool for engagement of the larger end 11 with a socket to deliver torque thereto in clockwise direction. FIG. 10 shows drive bar 10 installed in the tool for engagement of the smaller end 12 with a socket to deliver torque thereto in counterclockwise direction. FIG. 11 shows drive bar 10 installed in the tool for engagement of the smaller end 12 with a socket to deliver torque thereto in clockwise direction. FIG. 8 shows a plan view of drive bar 10 removed from the tool. A view taken from the larger end 11 of the drive bar 10 is shown at the center of FIG. 2. As shown in the above indicated figures, stops 13, welded to bar 10 to limit the distance it can be inserted into the tool by contact with ratchet 6, have the additional function, by virtue of extending outside of bearing member 20, of preventing an engaged socket from coming in contact with and abraiding bearing 20 during use of the tool, said function constituting an additional improvement over the former tool constructions. If desired, spring loaded retaining balls 14 indicated on the various views of bar 10 may be installed on the bar to hold the bar and an engaged socket in place during use of the tool.

IMPROVED LINKAGE BETWEEN INERTIA MEMBER AND POWER SPRING

The construction of the said co-pending patent application includes a cross slide operating in the tool handle to transmit force from the pitman to the power spring during compression of the spring, and from the spring to the pitman during decompression of the spring. While this construction is simple and economical to manufacture, it results in considerable friction between cross slide and handle with associated energy loss, particularly because it is difficult to maintain adequate lubrication between the mating sliding surfaces involved. FIGS. 2, 3 and 4 of the present application show the use of rollers 51, acting inside of a roller cage 69 in place of the cross slide of the former construction, one end of said roller cage being attached to handle flange 57 and the other end to spring stop 64 in turn attached to handle tube 56. Roller 51 operate rotationally on rollers pin 52 with very little friction, and with even less friction against the walls of the roller cage 69 without need for lubrication, the efficiency of the tool in transforming input torque on the handle to magnified output torque on drive bar 10 thus is increased over that of the former construction.

COMPRESSION AND RECOIL MEMBER

In the said co-pending patent application a cross slide stop is provided to prevent the force of the spring at the end of the spring decompression stroke from acting against the pitman, and in turn to prevent said force to cause the pawls to act forcibly against the stops on the frame members which would adversely affect the ratcheting action of the tool. Despite this provision, however, the friction between the handle and the tool head when the handle is moved in the ratcheting direction causes sufficient pressure of the pawls against the stop members to detract sometimes from the ease of movement of the handle in the ratcheting direction.

To overcome the above described difficulty, one construction of the present application provides an adjustable compression and recoil member 53 in the linkage between inertia member 4 and power spring 5. Movement of handle 2 in the ratcheting direction causes slight pivoting of frame members 21 and 22 about pivot pin 59 and resultant contact of recoil adjusting member 54 against the adjacent surface of inertia member 4 to halt further said pivoting and enable the ratcheting operation to proceed without forcible engagement of pawls 23 with stops 42, 43 and 44 on frame members 21 and 22. To ensure against said forcible engagement, pitman bearing member 48 and associated lock nut 50, and recoil adjusting member 54 and associated lock nut 55, are adjusted relative to one another so as to cause adjusting member 54 to contact the said surface of inertia member 4 before pitman bearing member 48 makes forcible contact with pitman pin 46.

Compression and recoil member 53 also acts to cause recoil compression of spring 5 as handle 2 pivots about pivot pin 59 causing recoil adjusting member 54 to contact the adjacent surface of inertia member 4 in such instances as pawls 23 contact stops 42, 43 and 44 forcibly as a result of all of the energy released by spring 5 not being delivered through drive bar 10 to a fastener being driven thereby.

IMPROVED FRAME MEMBER SUPPORT

In the construction of the said co-pending patent application, the frame members of the tool are joined by two cross members attached to the frame members by cap screws and nuts fixed to the frame members. With this construction, the ends of the frame members opposite the tool handle sometimes tend to separate undesirably from the ends of the inertia member.

In the construction of the present application, to correct the above described deficiency, an additional member is provided to join the frame members, consisting of a bolt 71 near the ends of frame members 21 and 22 opposite handle 2 on the extended longitudinal axis of handle 2, said bolt passing transversely of the tool consecutively through frame member 21, stop member 44, the open space within inertia member 4, stop member 43, and frame member 22. Stop member 43 is internally threaded to mate with threads on bolt 71 for joining frame member 21 with frame member 21, and to enable adjustment of the clearance between the frame members and the ends of inertia member 4 for proper operation relative to one another, which adjustment being held at the desired point by tightening lock nut 72 on bolt 71 against frame member 22.

INTERMEDIATE BEARING MEMBER FOR INERTIA MEMBER

The bearing surface 17 on inertia member 4 and on the mating bearing surface on bearing member 19 on frame members 21 and 22, when constructed conveniently and economically of the same material, such as of mild steel, sometimes tend to seize or gaul with one another, particularly under dirty service conditions, to which the tool is sometimes subjected, or with inadequate lubrication. The said co-pending patent application suggests placing balls between these surfaces, which not only adds to the cost and complexity of manufacture of the tool, but also causes operating difficulties under said dirty service conditions.

As a practical compromise solution to the stated problem with said bearing surfaces, the present application provides for the installation of an intermediate bearing member 18 between bearing surface 17 on inertia member 4 and bearing member 19 on frame members 21 and 22 consisting of an unattached strip of a material dissimilar in compostion to that of bearing surface 17 and bearing member 19, such as a metal, plastic, or a self-lubricating material such as an oil or graphite impregnated material, or the like.

MEANS FOR PARTIAL ENGAGEMENT OF THE PAWLS DURING SPRING COMPRESSION

In the construction of the manual torque magnifying tools of the said patents and of the said co-pending patent application, engagement of the pawls with the ratchet teeth serves to hold the ratchet and inertia member in static rotational relationship with respect to one another to enable compression of a power spring to store energy therein, on movement of the tool handle in a predetermined direction around the common axis of the ratchet and inertia member, for subsequent release as impact energy by the pawls on reengagement with the succeeding ratchet teeth following disengagement of the pawls from the immediately preceding ratchet teeth. On such reengagement, the pawls are caused by the pawl springs to be seated to the full depth of the ratchet teeth, from which position the pawls must be raised for subsequent disengagement, on movement of the tool handle to product another impact cycle, against the frictional force between the pawls and the ratchet teeth resulting from the pressure imposed by the power spring on the inertia member. This disengagement of the pawls from the full depth of the ratchet teeth by action of the cams to the point just short of imminent total disengagement from the ratchet teeth requires a substantial portion of the total energy necessary to move the tool handle through a complete impact producing cycle, said energy portion being unrecoverable as impact energy against the ratchet teeth, thus reducing the efficiency of the tool.

When the pawls engage the ratchet teeth with impact force during the impact producing portion of the operating cycle of the tool, their engagement to the full depth of the ratchet teeth is desirable from stress considerations. During the power spring compression portion of the operating cycle of the tool, however, the force between pawl and ratchet tooth is much less than occurs on impact of the pawl against the ratchet tooth so only partial engagement of pawl and ratchet tooth is necessary, such as is the condition unavoidably prevailing in the tools described in the said patents and in the said co-pending patent application immediately preceding disengagement of the pawls from the ratchet teeth following the pawls having been raised from engagement to the full depth of the ratchet teeth to the point of imminent total disengagement. Said partial engagement of the pawls with the ratchet during the spring compression portion of the operating cycle of the tool would eliminate the energy required to raise the pawls from the full depth of the ratchet to the point of imminent total disengagement, which is the major portion of the total energy required to disengage the pawls.

It is an object of this invention, in a manual torque magnifying impact tool, to provide means for engagement of the pawls with the ratchet teeth to less than the full depth of the teeth during the power spring compression portion of the operating cycle of the tool, and to provide for engagement of the pawls to the full depth of the ratchet teeth when the pawls engage the teeth with impact force during the impact producing portion of the operating cycle of the tool.

Figure 12:
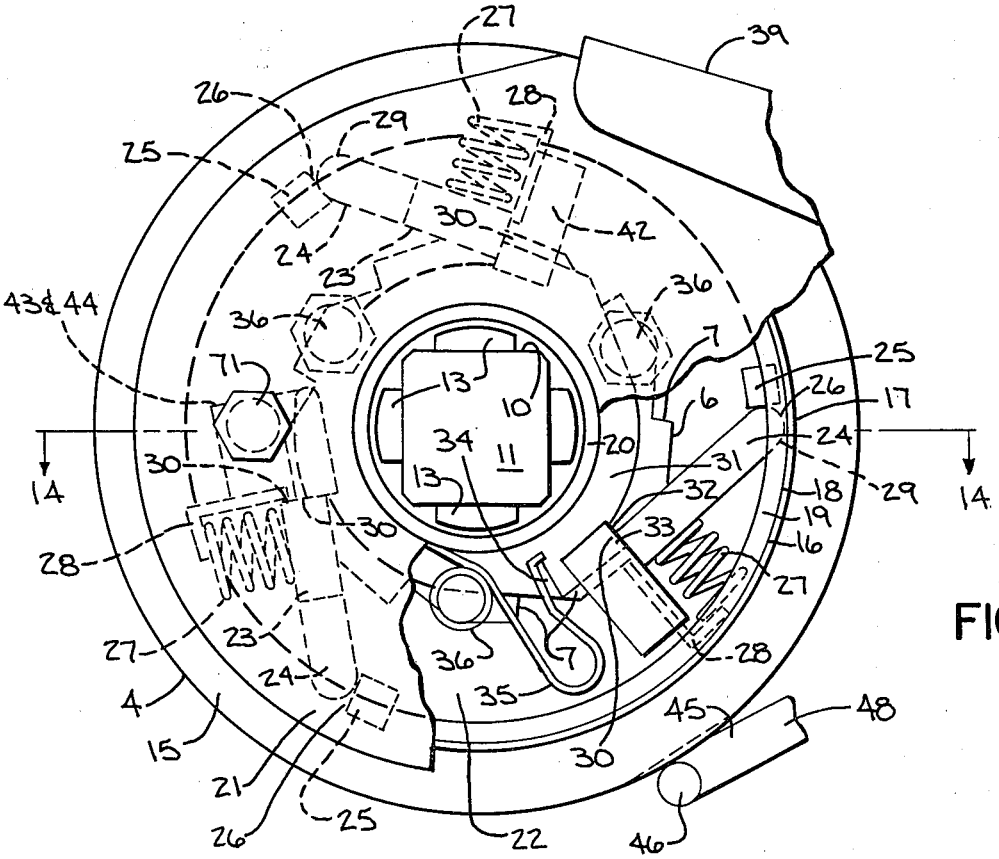
FIG. 12 is a transverse view of the tool with a portion of the near frame member cut away showing an alternative construction of the tool.
Figure 14:
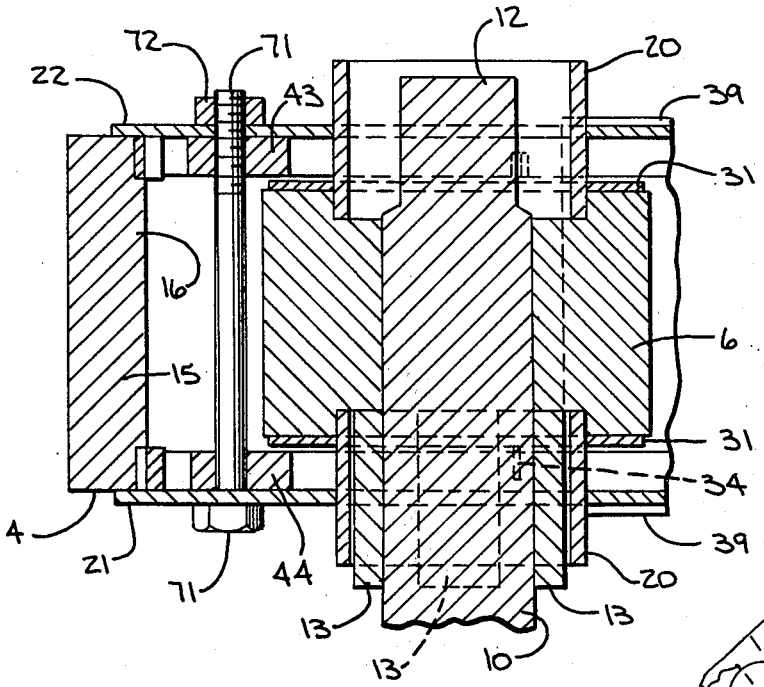
FIG. 14 is a cross sectional view taken along the line 14—14 of FIG. 12.
Figure 15:
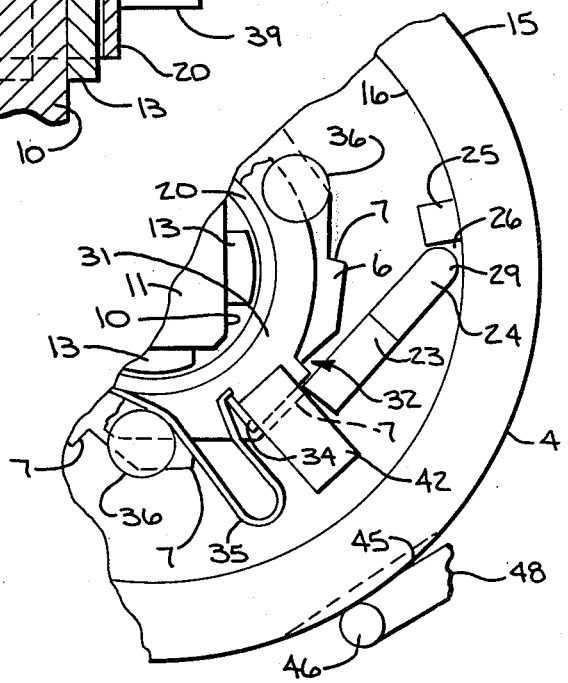
FIGS. 15 and 16 are views taken as in FIG. 12 showing the positions of certain parts of the tool at various stages during the operating cycle of the tool shown in FIG. 12.

A preferred construction to provide such means for partial and full engagement of the pawls is shown in FIGS. 12, 13, 14, 15, and 16, wherein an annual disc 31 of inner diameter to mate as a bearing with the outer surface of bearing member 20, and an outer diameter less than that of the outer diameter of ratchet 6 to establish a difference between the outer surface of the ratchet and that of the disc equal to the desired depth of partial engagement of pawl 23 with ratchet tooth 7, is interposed between the inner ends of cams 36 and one or both ends of ratchet 6, as shown in FIG. 14, said disc being operabtools, thus considerably reducing the duration of said clockwise movement required to disengage the pawls and the energy required therefor as compared with the pawl disengaging operation in the former related tools. operable rotationally on bearing member 20. As indicated in FIG. 12, notch 32 at the outer edge of disc 31, one such notch for each pawl 23, allows the pawls to be seated to the full depth of their respectively engaged ratchet teeth when the rotational position of disc 31 causes notches 32 to index laterally with the respective adjacent ratchet teeth 7. A spring 35, operating compressively between stop 34 on disc 31 and frame member 21 and 22, holds the edge 33 of notch 32 resiliently against, or in the direction of, end 30 of pawl 23. Movement of handle 2 in a counterclockwise direction about the axis of the ratchet 6 invokes the ratcheting action of the tool, causing pawls 23 to be drawn from engagement with the impact surface of ratchet teeth 7 to slide resiliently over the respective adjacent ratchet teeth. As indicated in FIG. 15, when a pawl has been raised sufficiently by such ratcheting action to be disengaged from notch 32 of disc 31, the disc is released to be impelled by spring 35 to rotate in counterclockwise direction on bearing member 20 to the point where stop 34 on disc 31 engages stop 42 on frame member 22, allowing the peripheral surface of disc 31 to pass underneath the end of pawl 23 and thus preclude full engagement of a pawl with a ratchet tooth by the contact of the end 30 of the pawl with the peripheral surface of disc 31. As counterclockwise handle 3 is continued, frame members 21–22 and disc 31 move together while the pawls 23 slide resiliently over ratchet teeth 7 until the end 30 of pawl 23 passes the impact surface of the adjacent ratchet tooth 7, whereupon the pawl drops radially with respect to the ratchet for partial engagement with ratchet tooth 7 and contact with the periphery of disc 31, said pawl thus being precluded from seating to the full depth of the said ratchet tooth by said contact. Following said partial engagement of the pawl with ratchet tooth 7, clockwise movement of handle 2 causes end 30 of pawl 23 to engage the outer tip of ratchet tooth 7, to initiate the spring compression portion of the operating cycle of the tool from the position of imminent disengagement of the pawls from the ratchet teeth, without the subsequent need for the cams 36 to raise the pawls 23 from full engagement with the ratchet teeth to reach the said position as is required in all former constructions of related tools, thus considerably reducing the duration of said clockwise movement required to disengage the pawls and the energy required therefor as compared with the pawl disengaging operation of the former related tools.

Figure 16:
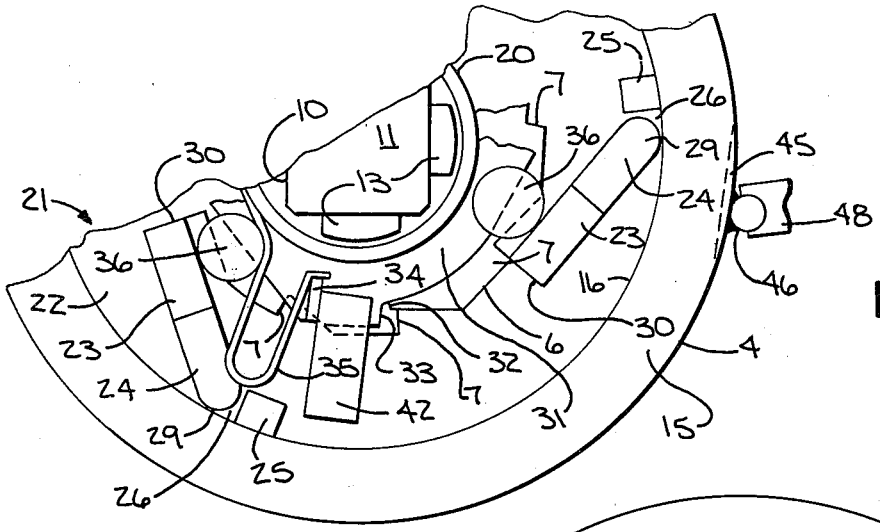

FIG. 16 shows the pawl 23 partially engaged with ratchet tooth 7, after clockwise movement of handle 2 to the point of imminent disengagement of the pawl. Following said clockwise movement, disc 31 has moved to the position indicated in FIG. 16 where the contact edge 33 of notch 32 has passed the impact surface of the adjacent ratchet tooth 7 to enable the pawl to seat to the full depth of the ratchet tooth on impact therewith. Clockwise rotation of ratchet 6 as a result of said impact causes end 30 of pawl 23 to engage edge 33 of notch 32 causing the disc 31 to rotate with the ratchet 6, the limit of such rotation being at the point where end 30 of pawl 23 engages stop 42 on frame 22, after which the tool parts involved resume their relative positions as indicated in FIG. 12, in readiness to have the above described cycle repeated.

The above described partial engagement of the pawls with the ratchet teeth is invoked only following counterclockwise movement of handle 2 for ratcheting operation of the tool. Continuous movement of the handle in clockwise direction to produce impacts of the pawls against the ratchet teeth will result in seating of the pawls to the full depth of the ratchet teeth on each such impact, requiring the pawls to be raised from said full depth for disengagement to produce impact against the succeeding ratchet teeth. This requirement of prior ratcheting action to obtain the advantage of partial engagement of the pawls with the ratchet teeth during the spring compression portion of the operating cycle of the tool might appear to seriously minimize the importance of this advantage. From a practical operating viewpoint, however, this is not the case, because in operation of the tool, the operator customarily first moves the tool handle in the direction of ratcheting to select the most convenient position of the handle for operation, or may do so deliberately to invoke easily said partial engagement of the pawls on the next impact producing movement of the tool handle. Following said prior counterclockwise movement of the tool handle, the operator moves the tool handle reciprocatingly for alternate ratcheting action and impact producing action repeatedly against the same set of ratchet teeth, thus invoking the said advantageous partial engagement of the pawls with the ratchet teeth during each instance of the spring compression portion of the operating cycle of the tool.

INTEGRAL CAM AND STOP MEMBER

The tools of U.S. Pat. Nos. 2,844,982, 2,954,714 and 3,108,506 have an integral member attached to each of the two frame members which carries interrupted bearing surfaces for supporting the inertia member rotationally about its axis, and cam surfaces as part of the same member circumferentially between said interrupted bearing surfaces. A stop member on the outer surface of the inertia member engages a stop member on each of the frame members to stop rotation of the inertia member in one direction when such stop is necessary during operation of the tool.

The tool of said co-pending patent application has a cam and inertia member stop construction which is an important improvement over the former construction of the three above mentioned patents, consisting of several separate stop members attached to each frame member at equal intervals around the axis of the inertia member, to enable engagement of each such stop member by the outer end of a pawl to stop rotation of the inertia member in one direction. While the importance of the said improvement achieved by the construction of said co-pending patent application is recognized, this construction also has certain deficiencies which are related both to performance of the tool and to contemplated volume of manufacture of the tool.

With regard to said performance of the tool, the separate cam for each pawl, consisting of the cylindrical head of a cap screw, results in the disengagement of the pawl during a lesser angle of movement of the handle about the axis of the inertia member than in the tools of the said three patents, so that the force required on the handle for said disengagement is distributed undesirably over a lesser portion of the full range of the handle movement than in the tools of said three patents.

With regard to volume of manufacture, the pawl disengaging and inertia member stop means of the tool of said co-pending application is well suited and advantageous in design and construction for manufacture of the tool assembly in relatively small quantities, because standard cap screws, installed in easily made holes in the frame members, can be used for the pawl disengaging cams, requiring very little special tooling or machine work for the manufacture of this portion of the tool. Likewise, the stop members on the tool frame can be made simply by cutting pieces of standard bar stock to the required length and welding them to the frame members. This advantage of economical manufacture in small quantities is considered to adequately outweigh the above mentioned force distribution on the handle during disengagement of the pawls, however, so the design and construction of said co-pending patent application is recommended for manufacture of the tool in relatively small quantities, such as might be the case with the larger sizes of the tool which ordinarily would not be sold in as large numbers as would be the smaller sizes.

When manufacture of relatively large quantities of the tool is contemplated, so that the cost of tooling for mass production can be distributed over many units, reduction in the cost of assembly of the cam and stop means of said co-pending patent application, consisting in each assembly of the tool of six cap screws, six nuts, and six stop members which must be individually welded to the frame members, advantageous alternative constructions of cam and stop members become possible. Accordingly, it is an object of this invention, in a manual torque magnifying impact tool, to provide an improvement in the construction of the means for disengagement of the pawls from the ratchet teeth, and for engagement with the outer ends of the pawls for stopping rotation of the inertia member in one direction about its axis.

Figure 17:
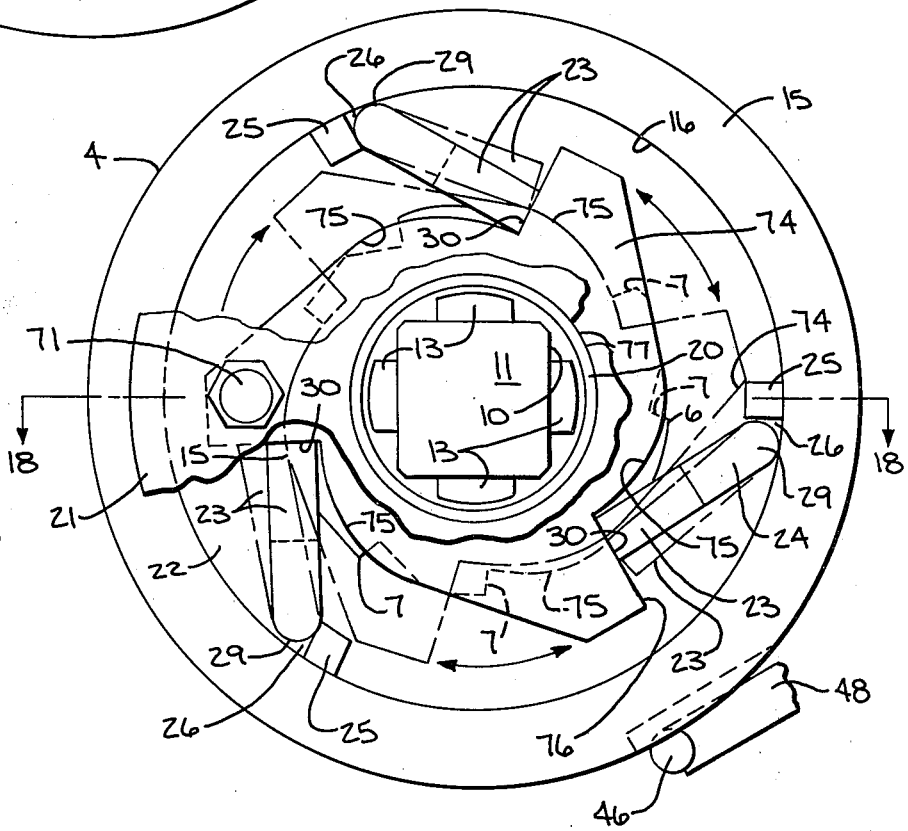
FIG. 17 is a transverse view of the tool with a portion of the near frame member and other parts of the tool omitted showing an alternative construction of the tool.
Figure 18:
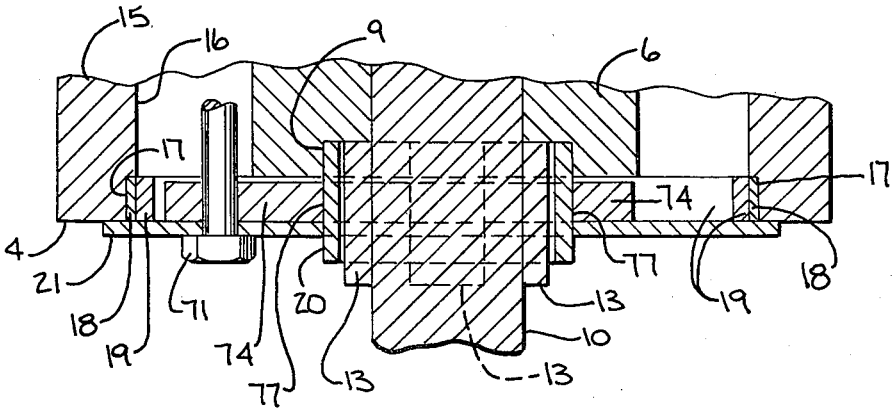
FIG. 18 is a cross sectional view taken along the line 18—18 of FIG. 17.

Referring to FIGS. 17 and 18, the improvement in the means for disengagement of the pawls and for stopping rotation of the inertia member referred to in the immediately preceding paragraph consists of a flat member 74, with a central opening 77 of diameter to enable passage of bearing member 20 therethrough, said member 74 having cam surfaces 75 of contour to provide for uniform disengagement of pawls 23 relative to movement of said handle, and equally spaced about, equidistant from, and parallel to the axis of said opening, and said member 74 also having stop surfaces 76 parallel to said axis and extending outward from said opening on a line parallel to an extension of a radius of said opening and equally spaced between said cam surfaces. As indicated in FIGS. 17 and 18, member 74 is assembled in the tool by placing opening 77 over bearing member 20 at frame member 21 and 22, and welding the outer edges of member 74 to the respective frame members. In such instance, bearing member 20 would be welded to the outside surface of frame members 21 and 22, instead of to the inside, as depicted elsewhere, to permit member 74 to fit closely against the surface of the frame members.

The solid lines in FIG. 17 show pawls 23 engaging stop surfaces 76 of member 74, and the dotted lines show the position of member 74 with the cam surfaces 75 in contact with the pawls 23 at the point of imminent disengagement of pawls 23 from ratchet teeth 7. Member 74 thus serves as an alternative to cam members 36 and stop surfaces 42, 43, and 44 of the tool of this application described elsewhere herein.

As a first alternative to the above described manner of assembly of member 74 in the tool, an edge of opening 77 could be chamfered and welded to bearing member 20 by a weld flush with the surface of member 74 to form an integral unit consisting of cam surfaces 75, stop surfaces 76, and bearing member 20 for subsequent assembly of said unit in the tool by welding or other attachment, such as by cap screws, to the said frame members. As a second alternative, said integral unit could be manufactured as a monolithic unit for subsequent assembly in the tool. As a third alternative, member 74 could consist of an assembly of parallel plates, stacked on one another, each of said plates having a cam surface 75 and a stop surface 76, said assembly being fixed to said frame members by suitable fastening means such as welding, rivets, bolts, or a combination thereof. Either of said alternatives serves as alternatives to cam members 36, stop surfaces 42, 43 and 44, and said third alternative includes bearing member 20 of the tool of this application, described elsewhere herein, as well.

As a first alternative construction of compression and recoil member 53, adjusting member 54 could be placed at the end of member 53 to contact power spring 5, with the opposite end of member 53 occasionally contacting inertia member 4, in which case member 54 could be replaced if desired by an assembly of spacing washers selected of appropriate thickness to provide the adjustable feature. As a second alternative construction of compression and recoil member 53, one adjusting member 54 would be carried at one end of member 53 for occasional contact with inertia member 4, and another member 54 carried at the opposite end of member 53 in contact with power spring 5, with a lock nut 55 on each such member 54, in which case the adjustable feature of pitman 47 would be unnecessary. As a third alternative construction, member 53 and pitman 47 would be made with a fixed non-adjustable length of dimension suitable for each, manufactured, along with other relevant parts of the tool, with adequate dimensional precision to preclude the need for the adjustable feature of member 53, of pitman 47, or of both.

As will be apparent from the foregoing description, the provision of a cylindrical tubular inertia member of substantially uniform wall thickness, carrying at or adjacent the inner surface thereof a seat for the pawl and a varying surface engaging bearing means coaxial with the common axis of the inertia member and the tool head, is an important feature of the construction contributing to the reduction in weight of the tool, weight reduction being a most important objective.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. A manually operable torque magnifying impact tool comprising a rotary tool head, an annular inertia member around said tool head on a common axis therewith, a frame member transverse the common axis at each end of the inertia member, a torque input handle extending transversely of said axis and connected to said frame member, bearing means coaxial with said axis and attached to said frame member guiding said tool head, inertia member, frame member and handle for relative angular movement about said axis, an elongated power spring within said handle, coupling means between said inertia member and said power spring for storing and releasing energy, said tool head including a cylindrical portion having a series of circumferentially equally spaced elongated ratchet teeth around its cylindrical surface parallel to said axis, a pawl pivotally seated at one edge in a seat on said inertia member, said pawl biased by pawl spring means for engagement of its unseated edge with said ratchet teeth, cam means rigid with said frame member around said axis operatingly contacting said pawl for its disengagement from and reengagement with said ratchet teeth to impart torque producing impact to said tool head on movement of said handle angularly in a predetermined direction about said axis relative to said tool head, a stop member on said frame member at times contacted forcibly by said unseated edge of said pawl following said disengagement of said pawl to stop rotation of said inertia member, a pivotal connection between said handle and same frame member to allow limited angular movement of said handle in one direction about said pivotal connection relative to said frame member about an axis parallel to the axis of said inertia member and remote from the longitudinal axis of said handle, said coupling means between said inertia member and said power spring including a spring stop member on said handle to limit decompressive movement of said power spring and including a pitman acting pivotally on said inertia member near the peripheral surface thereof and connected pivotally to a compression and recoil member in contact with said power spring, the combination of said pitman, said spring stop, and said compression and recoil member providing for compression and decompression of said power spring on said movement of said handle about said axis relative to said tool head in said predetermined direction, for interaction between said compression and recoil member and said handle on movement of the handle about said axis relative to said tool head in the direction opposite to the said predetermined direction to preclude forcible contact of said unseated end of said pawl with said stop on said frame member, and for said interaction responsive to said pivotal movement of the handle relative to said frame member following forcible engagement of said unseated edge of said pawl with said stop on said frame member to compress said power spring to stop rotation of said inertia member by absorbing kinetic energy of rotation therefrom.

2. The tool as claimed in claim 1 wherein said compression and recoil member includes a pivot pin with a roller member operable thereon and within said handle to carry the load transverse the longitudinal axis of said handle imposed by said pitman.

3. The tool as claimed in claim 1 wherein the length of said compression and recoil member is adjustable.

4. The tool as claimed in claim 1 including an integral cam and stop member attached to said frame member and carrying a cam surface and a stop surface, the combination comprising said cam means and said stop means attached to said frame member.

5. The tool as claimed in claim 1 including an integral cam, stop and bearing member attached to said frame member and carrying a cam surface, a stop surface, and a bearing surface, the combination comprising said cam means, said stop member attached to said frame member, and said bearing means for guiding said tool head.

6. The tool as claimed in claim 1 in which said tool head has a bearing surface at each end of said cylindrical portion coaxial with said axis and with an adjacent coaxial aperture in said frame member, said bearing surface engaging said bearing means attached to said frame member for guiding said tool head about said axis, an axial opening between said bearing surfaces of noncircular transverse shape of lesser maximum dimension than the minimum dimension of said aperture transverse said axis, a separable longitudinal drive member of uniform outer shape transverse and along the longitudinal axis thereof with a stop member attached intermediate the ends thereof, said outer shape matching said transverse shape of said opening, the combination of said matching shapes and said minimum and said maximum dimensions enabling insertion of said drive member through said aperture and into said opening and removal therefrom, the distance of said insertion being limited by contact of said stop member with said tool head, cooperation between said noncircular shape of said opening and said matching shape of said drive member providing for torsional immobility of said tool head and said drive member relative to one another.

7. The tool as claimed in claim 6 in which the length of said compression and recoil member is adjustable.

8. A tool as claimed in claim 6 in which said inertia member comprises a cylindrical tubular member of substantially uniform wall thickness carrying at or adjacent the inner surface thereof said seat for said pawl and a bearing surface engaging said bearing means coaxial with said axis.

9. The tool as claimed in claim 8 including an integral cam and stop member attached to said frame member and carrying a cam surface and a stop surface, the combination comprising said cam means and said stop member attached to said frame member.

10. A manually operable torque magnifying impact tool comprising a rotary tool head, an inertia member surrounding the tool head on a common axis therewith, a frame member transverse the common axis at each end of said inertia member, a torque input handle extending transversely of said axis and connected to said frame member, an elongated power spring within said handle, coupling means between said power spring and said inertia member providing for storing and releasing energy on movement of said handle about said axis, bearing means coaxial with said axis and attached to said frame member guiding said tool head, inertia member, frame member and handle for relative angular motion about said axis, said tool head including a cylindrical portion having a series of circumferentially equally spaced elongated ratchet teeth thereon parallel to said axis, pawls pivotally seated at one edge on said inertia member with the unseated edge thereof spring biased for engagement with said ratchet teeth, cam means rigid with said frame member for disengagement of said pawls from and reengagement with said ratchet teeth to produce impact against the ratchet teeth and torque on said tool head as said handle is moved in a predetermined direction about said axis relative to said tool head, interacting means between said inertia member and said handle providing for holding said inertia member rotationally immobile relative to said axis when said handle is not being moved in said predetermined direction and for stopping rotation of the said inertia member relative to the handle when required during operation of the tool, and means providing for partial engagement of said pawl with said ratchet teeth during the energy storing portion of the operating cycle of the tool and for full engagement of said pawls with said ratchet teeth during the energy releasing portion of the operating cycle of the tool.

11. The tool as claimed in claim 10 wherein the said means providing for said partial engagement of said pawls with said ratchet teeth and for said full engagement of said pawls with said ratchet teeth includes a disc member of lesser diameter than that of said tool head interposed and supported between the said cam means and the adjacent end of said tool head for rotation on said axis, contact of the said unseated edge of said pawls with the peripheral surface of said disc member to preclude said full engagement and provide for said partial engagement, peripheral notches on said disc member providing recesses for said unseated edges of said pawls to enable said full engagement of the pawls with said ratchet teeth when said notches are indexed laterally with said ratchet teeth, and means responsive to movement of said handle in the direction opposite to said predetermined direction to provide for said contact and said partial engagement, and means responsive to movement of said handle in said predetermined direction to provide for said indexing and said full engagement.

12. A manually operable torque magnifying impact tool comprising a rotary tool head, an inertia member surrounding said tool head on a common axis therewith, a frame member transverse the common axis at each end of the inertia member, a torque input handle extending transversely of said axis and connected to said frame member, bearing means coaxial with said axis and attached to said frame member guiding said tool head, inertia member, frame member and handle for relative angular movement about said axis, an elongated power spring within said handle, coupling means between said inertia member and said power spring for storing and releasing energy, said tool head including a cylindrical portion having a series of circumferentially equally spaced elongated ratchet teeth around its cylindrical surface parallel to said axis, a pawl pivotally seated in a seat on said inertia member, said pawl biased by spring means for engagement of its unseated edge with said ratchet teeth, cam means rigid with said frame member around said axis operatingly contacting said pawl for its disengagement from and reengagement with said ratchet teeth to impart torque producing impact to said tool head on movement of said handle in a predetermined direction about said axis relative to said tool head, a stop member on said frame member at times contacted forcibly by said unseated edge of said pawl following said disengagement of said pawl to stop rotation of said inertia member, said cam means and said stop member on said frame member comprising an integral cam and stop member attached to said frame member and carrying a cam surface for contacting said pawl and a stop surface at times contacted forcibly by said unseated edge of said pawl.

13. The impact tool as claimed in claim 12, including a longitudinal drive member of uniform non-circular outer and transverse shape along the longitudinal axis thereof, with a stop member attached to said drive member intermediate the ends thereof, and said tool head having an axial opening between the ends thereof of transverse shape matching said transverse shape of said drive member to enable insertion and removal of said drive member into and from said opening, respectively, from either side of said tool, the distance of said insertion of said drive member into said opening being limited by contact of said stop member with an end of said tool head, and in which said inertia member comprises a cylindrical tubular member of substantially uniform wall thickness carrying at or adjacent the inner surface thereof said seat for said pawl and a bearing surface engaging said bearing means coaxial with said axis.

* * * * *

UNITED STATES PATENT AND TRADEMARK OFFICE

CERTIFICATE OF CORRECTION

PATENT NO. : 4,418,768

DATED : December 6, 1983

INVENTOR(S) : OSCAR J. SWENSON

It is certified that error appears in the above-identified patent and that said Letters Patent is hereby corrected as shown below:

Column 1, line 56, "fomer" should read --former--.

Column 3, line 50, "72" should read --73--.

Column 5, line 35, "Roller" should read --Rollers--.

Column 5, line 36, "rollers" should read -- roller --.

Column 6, line 33, "21" (2nd occurrence) should read -- 22 --.

Column 7, line 15, "product" should read --produce--; line 60, "annual" should read --annular--.

Column 8, line 1, after "being", cancel remainder of line, through "tools" in line 5.

Column 8,line 25, cancel "on frame member 22" .

Column 8, line 65, cancel "on frame 22".

Column 12, line 21, "same" should read --said--.

Signed and Sealed this

*Thirteenth* Day of *March 1984*

[SEAL]

*Attest:*

GERALD J. MOSSINGHOFF

*Attesting Officer*

*Commissioner of Patents and Trademarks*